US007404624B2

(12) United States Patent
Sohn et al.

(10) Patent No.: US 7,404,624 B2
(45) Date of Patent: Jul. 29, 2008

(54) INK-JET PRINTHEAD AND INK EXPELLING METHOD USING A LASER

(75) Inventors: Dong-kee Sohn, Seoul (KR); Keon Kuk, Yongin-si (KR); Seung-joo Shin, Seongnam-si (KR); Yong-soo Oh, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 302 days.

(21) Appl. No.: 10/757,540

(22) Filed: Jan. 15, 2004

(65) Prior Publication Data

US 2004/0201646 A1 Oct. 14, 2004

(30) Foreign Application Priority Data

Jan. 15, 2003 (KR) ..... 10-2003-0002730

(51) Int. Cl.
*B41J 2/14* (2006.01)

(52) U.S. Cl. ..... 347/52

(58) Field of Classification Search ..... 347/51, 347/52, 54

See application file for complete search history.

(56) References Cited

U.S. PATENT DOCUMENTS

| | | | | |
|---|---|---|---|---|
| 4,308,547 | A | 12/1981 | Lovelady et al. | |
| 5,021,808 | A | 6/1991 | Kohyama | |
| 5,713,673 | A | 2/1998 | Nemoto et al. | |
| 6,474,783 | B1 * | 11/2002 | Pilossof et al. | 347/51 |
| 6,582,058 | B2 * | 6/2003 | Yi et al. | 347/47 |
| 7,025,442 | B2 * | 4/2006 | Yaron | 347/54 |
| 2002/0135664 | A1 | 9/2002 | Mashimo et al. | |

FOREIGN PATENT DOCUMENTS

| | | |
|---|---|---|
| EP | 0 999 049 A2 | 5/2000 |
| EP | 0 999 049 A3 | 5/2000 |
| EP | 1 008 451 A2 | 6/2000 |
| EP | 1 008 451 A3 | 6/2000 |
| JP | 3-187758 | 8/1991 |
| JP | 2000-168090 | 6/2000 |

* cited by examiner

*Primary Examiner*—An H Do
(74) *Attorney, Agent, or Firm*—Lee & Morse, P.C.

(57) ABSTRACT

An ink-jet printhead using a laser to expel ink includes an ink chamber to be filled with ink and an ink channel to supply the ink chamber with ink, the ink chamber and the ink channel formed in a passageway plate, a cover plate provided on the passageway plate, an ink ejection hole formed through the cover plate at a position corresponding to the ink chamber, a condenser lens provided on a bottom surface of the passageway plate at a position corresponding to the ink chamber, the laser irradiating a laser beam through the condenser lens and directly onto the ink contained in the ink chamber, to generate pressurized waves that vibrate a surface of the ink which causes an ink droplet to be expelled through the ink ejection hole from the surface of the ink.

26 Claims, 4 Drawing Sheets

INK-JET PRINTHEAD AND INK EXPELLING METHOD USING A LASER

BACKGROUND OF THE INVENTION

1. Field of the Invention

The present invention relates to an ink-jet printhead and an ink expelling method. More particularly, the present invention relates to an ink expelling method using a laser and an ink-jet printhead utilizing the method.

2. Description of the Related Art

Typically, ink-jet printheads are devices for printing a predetermined image, color or black, by ejecting a small volume droplet of printing ink at a desired position on a recording sheet. In such ink-jet printheads, ink ejection mechanisms are largely categorized into two types depending on which ink droplet ejection method is used. One type of conventional ink-jet printhead is a thermally driven ink-jet printhead in which a heat source is employed to generate bubbles in ink to cause ink droplets to be ejected by an expansion force of the generated bubbles. However, the thermally driven type, in which ink is boiled to generate bubbles, requires excess energy. In addition, there is a limitation on the type of ink used.

In addition to the above-described ink droplet ejection mechanism, a variety of different ink droplet ejection mechanisms are conventionally used in ink-jet printheads, and one example is shown in FIG. 1.

Referring to FIG. 1, a piezoelectric crystal 15 having a concave surface and a convex surface is installed under a surface of ink 14. One electrode 16 is provided on the concave surface of the piezoelectric crystal 15 and three electrodes 17, 18, 19 are provided on the convex surface of the piezoelectric crystal 15. The piezoelectric crystal 15 produces sonic energy, and an acoustic pressure generated by the sonic energy vibrates the surface of the ink 14. If the acoustic pressure exceeds a surface tension of the ink 14 and atmospheric pressure, ink droplets A-E are expelled from the surface of the ink 14 through a hole in a plate 13. Selective combinations of the electrodes 16, 17, 18, and 19 control an expelling direction of each of the droplets A-E. However, the above-described expelling method presents a problem due to a complex structure thereof because the hemispherical piezoelectric crystal 15 and the electrodes 16, 17, 18, 19 should be installed under the surface of the ink 14.

FIG. 2 illustrates another conventional printhead based on an ink droplet expelling mechanism using a laser.

Referring to FIG. 2, a printhead 40 includes chambers 37C, 37M, 37Y containing multiple colored inks 22C, 22M, 22Y, a semiconductor laser 28 for selectively irradiating a laser beam L onto the inks 22C, 22M, 22Y, and a condenser lens 29 which converges the laser beam L. The laser beam L emitted from the semiconductor laser 28 is selectively irradiated through the condenser lens 29 onto the inks 22C, 22M, 22Y contained in the chambers 37C, 37M, 37Y. Accordingly, the inks 22C, 22M, 22Y evaporate and the evaporating inks 32C, 32M, 32Y move to a recording sheet of paper 50. This ink expelling method, however, is disadvantageous in that control of the procedure is complex and a large amount of energy is consumed.

Other conventional ink expelling mechanisms include an ink expelling mechanism in which a buffered solution is boiled using a laser and ink is expelled by vibrations caused by the boiling of the buffered solution. This mechanism also has similar problems in that the structure of the ink-jet printhead is complex and a large amount of energy is consumed.

SUMMARY OF THE INVENTION

In an effort to solve at least some of the above-described problems, the present invention provides an ink-jet printhead configured to cause ink to vibrate using a laser, thereby using the vibration to expel ink, and an ink expelling method.

According to a feature of an embodiment of the present invention, an ink-jet printhead includes an ink chamber to be filled with ink and an ink channel to supply the ink chamber with ink, the ink chamber and the ink channel formed in a passageway plate, a cover plate provided on the passageway plate, an ink ejection hole formed through the cover plate at a position corresponding to the ink chamber, a condenser lens provided on a bottom surface of the passageway plate at a position corresponding to the ink chamber, and laser beam irradiating means for irradiating a laser beam through the condenser lens and onto ink contained in the ink chamber, wherein a surface of the ink is vibrated by a pressurized wave generated by the laser beam, and a vibration causes an ink droplet to be expelled through the ink ejection hole from the surface of the ink.

The passageway plate may be formed of a silicon substrate that is transparent with respect to an infrared ray and the laser beam irradiating means may be an infrared laser or the passageway plate may be formed of a glass substrate. Preferably, the laser beam irradiating means is a semiconductor laser.

In an embodiment of the present invention, the condenser lens may be integrally formed with the passageway plate.

An embodiment of the ink-jet printhead may further include a lens plate provided on the bottom surface of the passageway plate, the lens plate including the condenser lens. Preferably, the condenser lens is convex shaped.

The ink chamber may be a plurality of ink chambers positioned at predetermined intervals in the passageway plate, the ink ejection hole may be a plurality of ink ejection holes, each formed at a location corresponding to one of the plurality of ink chambers, and the condenser lens may be a plurality of condenser lenses, each formed at a location corresponding to one of the plurality of ink chambers.

The laser beam irradiating means may include a semiconductor laser and a light path controller for controlling a path of a laser beam emitted from the semiconductor laser.

The cover plate may be a silicon substrate and may have a hydrophobic surface.

The ink ejection hole may have a circular, oval or polygonal shape. Preferably, the ink ejection hole is sufficiently large to prevent contact between the ink droplet being expelled and the cover plate.

According to another feature of an embodiment of the present invention, a method of expelling ink includes filling an ink chamber with ink, irradiating a laser beam onto the ink contained in the ink chamber to generate a pressurized wave in the ink and vibrating a surface of the ink using the pressurized wave, and expelling an ink droplet from the surface of the ink by the vibration of the surface of the ink.

The method may further include converging the laser beam using a condenser lens before irradiating the laser beam onto the ink.

Preferably, the laser beam has a sufficiently high energy and is irradiated onto the ink for a sufficiently short period of time to prevent boiling the ink.

In the method, the ink chamber may be a plurality of ink chambers and irradiating the laser beam onto the ink may include selectively irradiating the laser beam onto ink contained in one or more of the plurality of ink chambers.

According to the present invention, ink is expelled by being vibrated and without being boiled. Accordingly, energy efficiency is relatively high and a printing speed increases. In addition, there are few limitations on a type of ink used. Further, the ink-jet printhead has a simplified structure.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
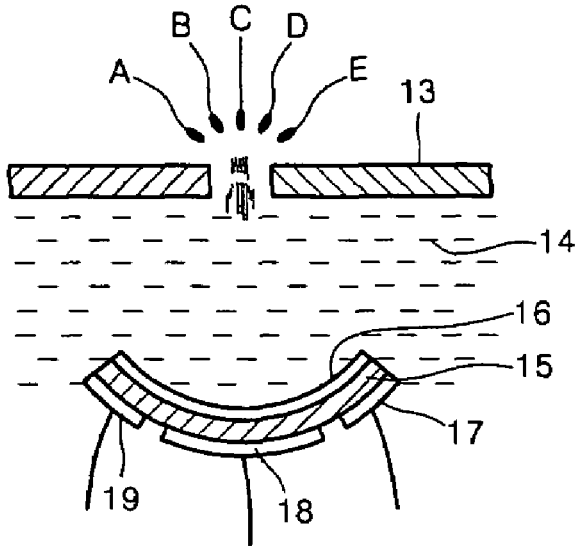
FIG. 1 (PRIOR ART)
FIG. 1 illustrates an example of a conventional ink expelling mechanism using an acoustic pressure.
Figure 2:
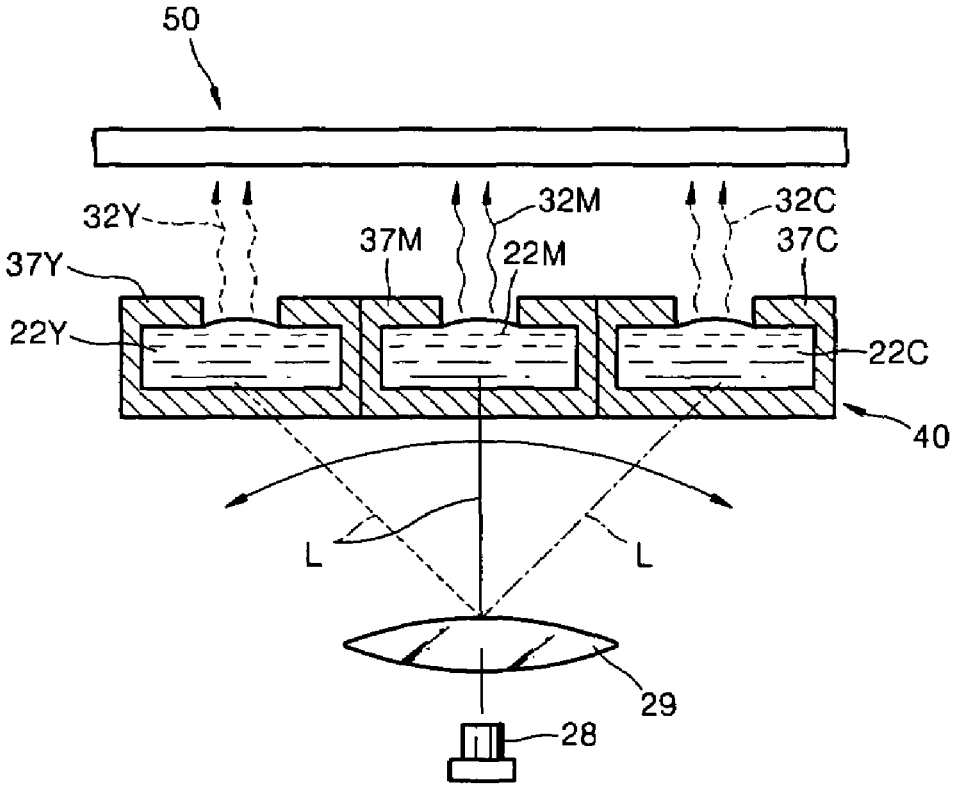
FIG. 2 (PRIOR ART)
FIG. 2 illustrates another example of a conventional ink expelling mechanism using lasers.

Korean Patent Application No. 2003-2730, filed on Jan. 15, 2003, and entitled: "Ink-Jet Printhead and Ink Expelling Method," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. It will also be understood that when a layer is referred to as being "on" another layer or substrate, it can be directly on the other layer or substrate, or intervening layers may also be present. In the drawings, the thickness of layers and regions are exaggerated for clarity. Like reference numerals refer to like elements throughout.

Figure 3:
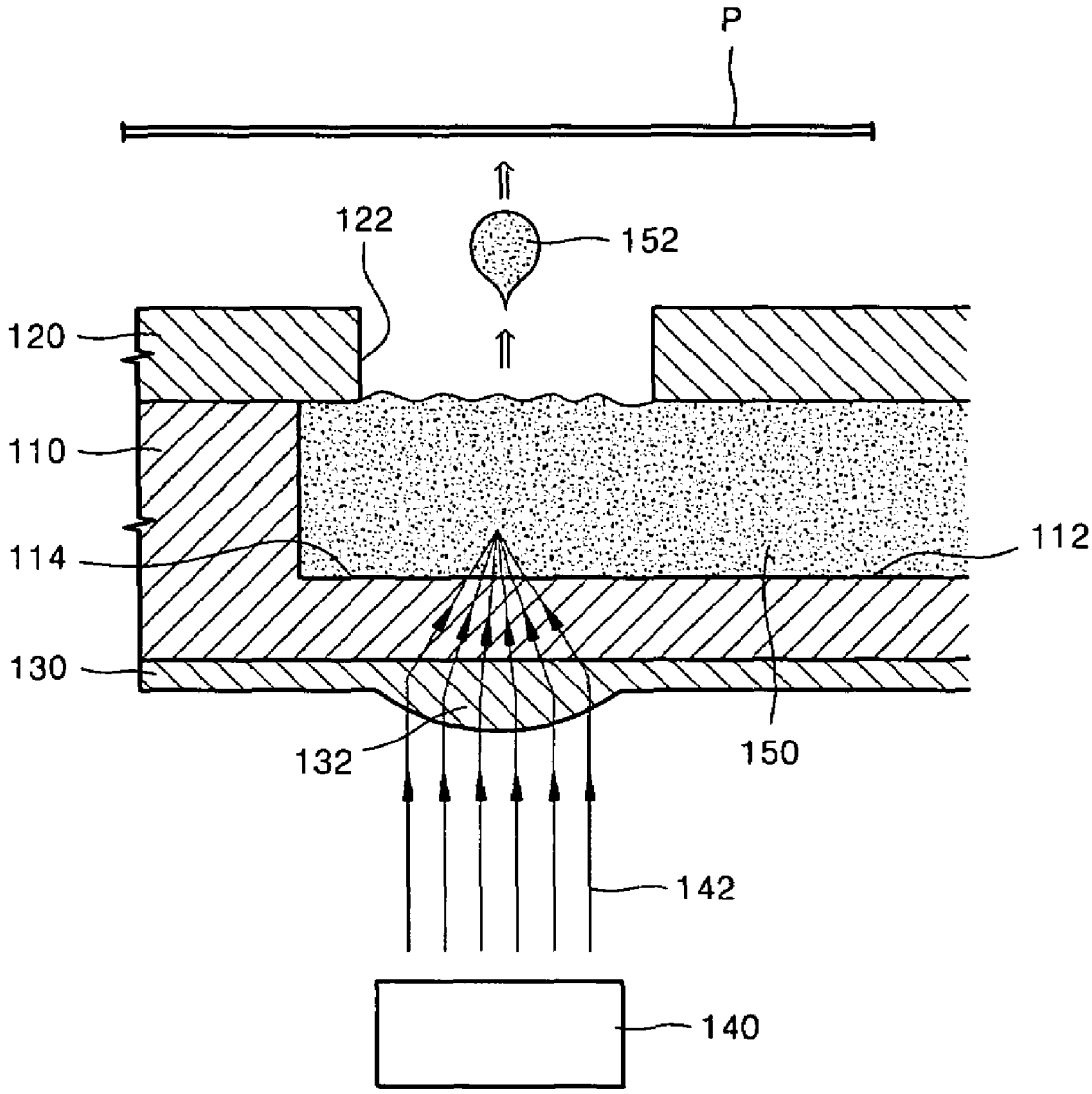
FIG. 3 illustrates a cross-sectional view of a unit structure of an ink-jet printhead according to a first embodiment of the present invention.

FIG. 3 illustrates a cross-sectional view of a unit structure of an ink-jet printhead according to a first embodiment of the present invention.

Referring to FIG. 3, a passageway plate 110 includes an ink chamber 114 filled with ink 150 to be expelled and an ink channel 112 for supplying the ink chamber 114 with the ink 150. An ink ejection hole 122 is formed through a cover plate 120, which is stacked on the passageway plate 110, at a position corresponding to the ink chamber 114.

The ink 150 contained in the ink chamber 114 is expelled in the form of a droplet 152 through the ink ejection hole 122. In the first embodiment of the present invention, a lens plate 130 is provided on a bottom surface of the passageway plate 110. A condenser lens 132 is provided at a position of the lens plate 130 corresponding to the ink chamber 114. A laser beam irradiating means, e.g., a semiconductor laser 140, for irradiating a laser beam 142 through the condenser lens 132 and onto the ink 150 contained in the ink chamber 114, is provided under the lens plate 130.

The ink chamber 114 is filled with the ink 150 supplied from an ink reservoir (not shown) through the ink channel 112. The ink 150 may be supplied to the ink chamber 114 by a capillary force.

The passageway plate 110 surrounding the ink chamber 114 and the ink channel 112 may be formed of a transparent material through which a laser beam 142 is transmitted, e.g., a silicon substrate that is transparent with respect to infrared rays. Alternately, the passageway plate 110 may be formed of a glass substrate, which is transparent with respect to visible light and ultraviolet rays as well as infrared rays. If the passageway plate 110 is formed of a silicon substrate, an infrared ray is used as the laser beam 142. If the passageway plate 110 is formed of a glass substrate, there are few limitations on the type of laser beam 142 used.

The cover plate 120 may also be formed of a silicon substrate, or other various kinds of materials may also be used. However, in view of a surface property of the cover plate 120, the cover plate 120 preferably has a hydrophobic surface so that the ink 150 is not easily smeared. As described above, the cover plate 120 has the ink ejection hole 122, which does not function as a nozzle but functions as a path through which an ink droplet 152 is expelled from a free surface of the ink 150 contained in the ink chamber 114. Preferably, the ink ejection hole 122 is sufficiently large to prevent contact between the ink droplet 152 being expelled and the cover plate 120. The ink ejection hole 122 is preferably circular in shape, but it may have various other shapes, including an oval or polygonal shape.

As described above, the lens plate 130 has the condenser lens 132 at a position corresponding to the ink chamber 114. The condenser lens 132 is shaped of a convex lens, as shown in FIG. 3, and converges the laser beam 142 emitted from the semiconductor laser 140 to be focused on a predetermined portion of the ink 150 contained in the ink chamber 114. In a state in which the condenser lens 132 is formed, the lens plate 130 may be attached to the bottom surface of the passageway plate 110. The condenser lens 132 may be formed by microprocessing a resultant structure formed after the lens plate 130 is disposed on the bottom surface of the passageway plate 110.

The mechanism of expelling an ink droplet from the ink-jet printhead according to the first embodiment of the present invention will now be described with reference to FIG. 3.

First, ink 150 fills the ink chamber 114. The ink 150 may be supplied into the ink chamber 114 through the ink channel 112 by a capillary force.

Subsequently, the laser beam 142 emitted from the semiconductor laser 140 is converged by the condenser lens 132 and irradiated onto a predetermined portion of ink 150 within the ink chamber 114. As described above, when the laser beam 142 is irradiated onto the ink 150, energy of the laser beam 142 is absorbed by the ink 150. Particularly, if a laser beam having high energy is irradiated onto the ink 150 for a relatively short time, a pressure of the ink 150 increases before it boils, which creates a pressurized wave that is then transferred to the free surface of the ink 150, thereby vibrating the free surface of the ink 150. As the energy supplied from the laser beam 142 increases, the amplitude of the free surface of the ink 150 increases. If the amplitude is greater than or equal to a predetermined level, the ink droplet 152 exceeds the surface tension and atmospheric pressure and is separated from the free surface of the ink 150. The separated ink droplet 152 is expelled through the ink ejection hole 122 toward a recording sheet of paper P provided in front of the ink droplet 152. As the ink droplet 152 is expelled, ink 150 refills the ink chamber 114 through the ink channel 112.

As described above, in the ink expelling method of the ink-jet printhead according to the first embodiment of the present invention, the ink 150 is expelled only by being vibrated by the laser beam 142 rather than by being boiled.

Thus, a relatively high efficiency of energy can be achieved. In addition, since a step of boiling the ink 150 is not performed, an expelling frequency of the ink droplet 152 may be further increased, thereby providing a higher speed of printing. Further, there are few limitations on the type of ink used.

Figure 4:
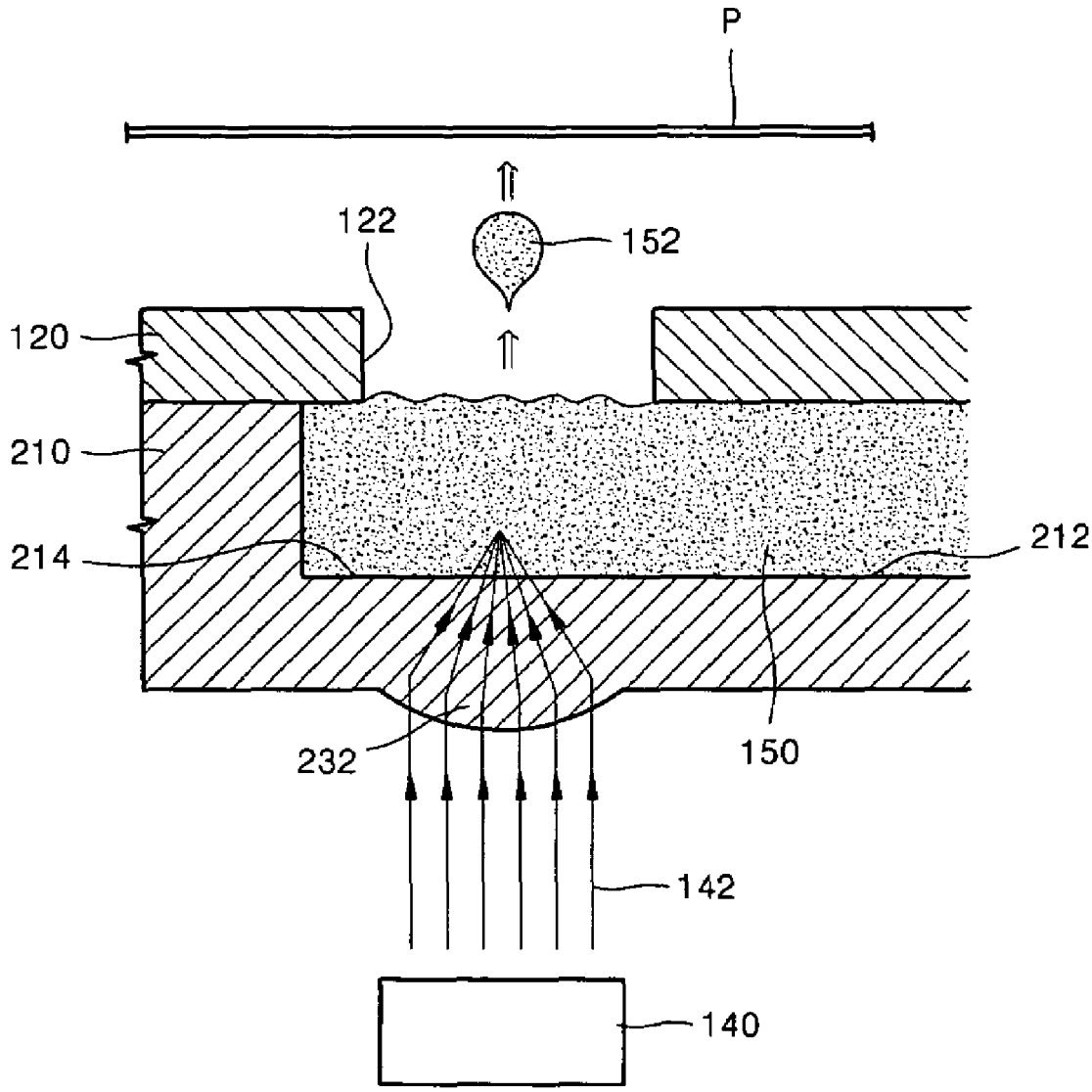
FIG. 4 illustrates a cross-sectional view of a unit structure of an ink-jet printhead according to a second embodiment of the present invention.

FIG. 4 illustrates a cross-sectional view of a unit structure of an ink-jet printhead according to a second embodiment of the present invention. The unit structure of the ink-jet printhead according to the second embodiment is the same as that of the first embodiment, except that a condenser lens is integrally formed with a passageway plate. Accordingly, an explanation of the common elements will be omitted.

Referring to FIG. 4, in the ink-jet printhead according to the second embodiment of the present invention, a passageway plate 210 having an ink chamber 214 and an ink channel 212 may be formed of a material through which a laser beam 142 is transmitted, e.g., a silicon substrate or a glass substrate.

In the second embodiment, a condenser lens 232 is integrally formed with the passageway plate 210. More specifically, the condenser lens 232 is formed by directly microprocessing the bottom surface of the passageway plate 210, which is made of a silicon substrate or a glass substrate. Thus, since a separate lens plate (130 of FIG. 3, illustrating the first embodiment) is not necessary, the structure and manufacturing process of the ink-jet printhead according to the second embodiment may be simplified. The condenser lens 232 is convex shaped and provided at a position corresponding to the ink chamber 214. The condenser lens 232 converges the laser beam 142 emitted from a semiconductor laser 140 to be focused on a predetermined portion of the ink 150 contained in the ink chamber 214.

The ink expelling mechanism of the ink-jet printhead according to the second embodiment is the same as that of the first embodiment.

Figure 5:
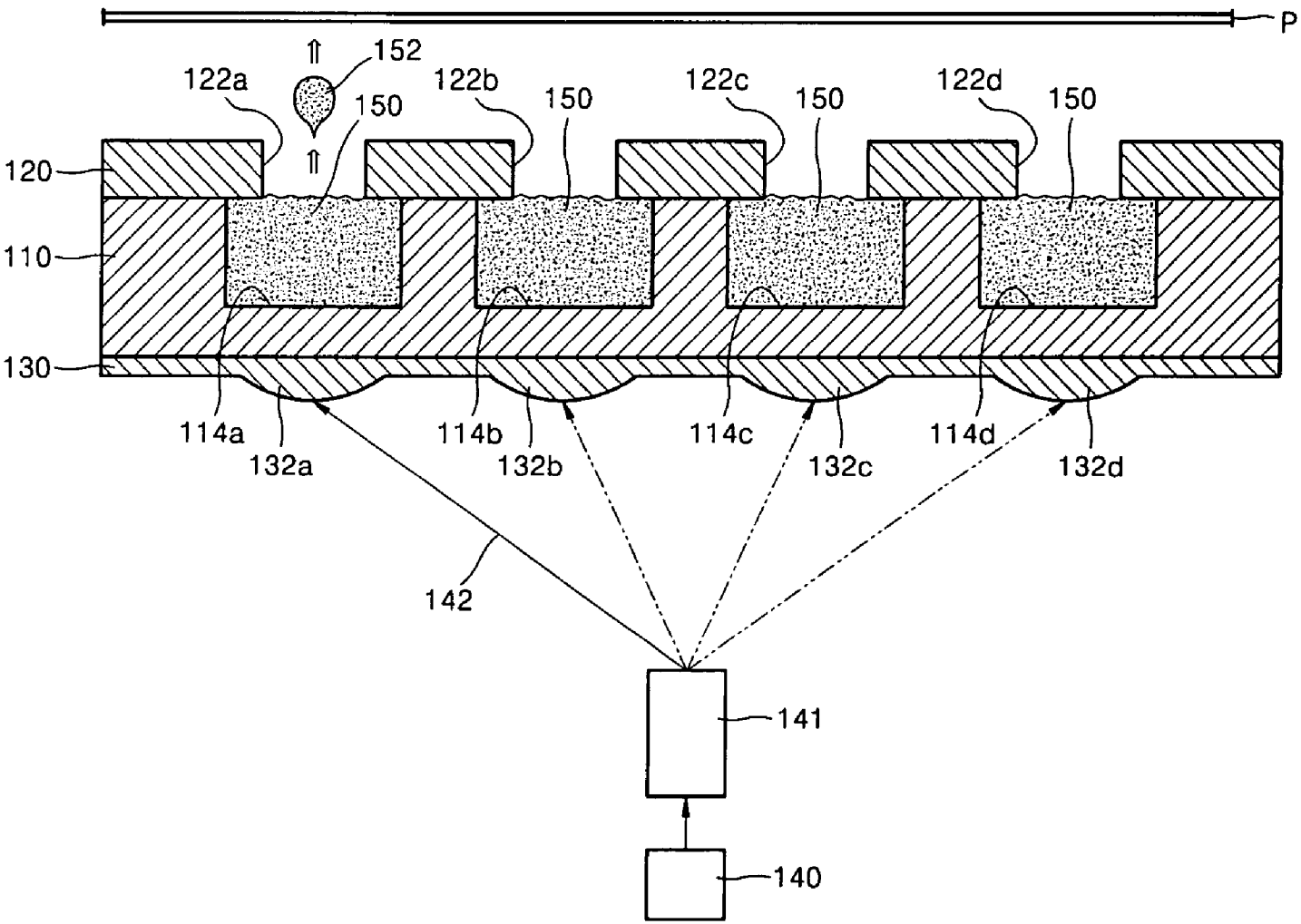
FIG. 5 illustrates a detailed implementation example of the present invention of an ink-jet printhead having a plurality of ink chambers and ink ejection holes.

FIG. 5 illustrates a detailed implementation example of the present invention of an ink-jet printhead having a plurality of ink chambers and ink ejection holes.

Referring to FIG. 5, a plurality of ink chambers 114*a*-114*d* are arranged in a passageway plate 110 each at a predetermined interval, and ink 150 fills the respective ink chambers 114*a*-114*d*. Although not shown, an ink channel is connected to each of the plurality of ink chambers 114*a*-114*d*, as in FIG. 3. A plurality of ink ejection holes 122*a*-122*d* are formed in a cover plate 120, which is disposed on the passageway plate 110, each at a position corresponding to one of the plurality of ink chambers 114*a*-114*d*. In addition, a plurality of condenser lenses 132*a*-132*d* are provided in a lens plate 130 provided on the bottom surface of the passageway plate 110 to correspond to the plurality of ink chambers 114*a*-114*d*. As described above, in an alternate configuration, the plurality of condenser lenses 132*a*-132*d* may be integrally formed with the passageway plate 110.

When the plurality of ink chambers 114*a*-114*d* are provided in the passageway plate 110 as shown in FIG. 5, a light path controller 141 and a semiconductor laser 140 are provided as a laser beam irradiating means. The light path controller 141 controls a path of a laser beam 142 emitted from the semiconductor laser 140 so that the laser beam 142 is selectively irradiated onto the ink 150 contained in the respective ink chambers 114*a*-114*d*. For example, as shown in FIG. 5, if the laser beam 142 emitted from the semiconductor laser 140 is controlled by the light path controller 141 to be irradiated onto the ink 150 contained in the first ink chamber 141*a*, an ink droplet 152 is expelled from a free surface of the ink 150 toward a recording sheet of paper P, as has been described above.

Thus, since ink 150 contained in the plurality of ink chambers 114*a*-114*d* may be expelled by a single semiconductor laser 140 and a single light path controller 141, the structure of the ink-jet printhead according to an embodiment of the present invention is simplified, as compared to that of the conventional ink-jet printhead. Therefore, since an ink-jet printhead having a plurality of ink chambers may be easily manufactured, a high-integration, high-resolution ink-jet printhead can be provided.

As described above, according to the present invention, since ink is expelled by being vibrated and not by being boiled, using a laser beam, energy efficiency is relatively high and a high speed of printing is facilitated. In addition, there are few limitations on the type of ink used.

Further, the ink-jet printhead according to the present invention has a simplified structure as compared to conventional ink-jet printheads. Therefore, a high-integration, high-resolution ink-jet printhead having a plurality of ink ejection holes may be easily implemented.

Preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An ink-jet printhead, comprising:

an ink chamber to be filled with ink and an ink channel to supply the ink chamber with ink, the ink chamber and the ink channel formed in a passageway plate;

a cover plate provided on the passageway plate;

an ink ejection hole formed through the cover plate at a position corresponding to the ink chamber;

a condenser lens provided on a bottom surface of the passageway plate at a position corresponding to the ink chamber; and laser beam irradiating means for irradiating a laser beam through the condenser lens and passageway plate into the ink chamber, directly energizing the ink contained in the ink chamber, wherein a surface of the ink is vibrated by a pressurized wave generated by the laser beam, and a vibration causes an ink droplet to be expelled through the ink ejection hole from the surface of the ink.

2. The ink-jet printhead as claimed in claim 1, wherein the passageway plate is formed of a silicon substrate that is transparent with respect to an infrared ray.

3. The ink-jet printhead as claimed in claim 2, wherein the laser beam irradiating means is an infrared laser.

4. The ink-jet printhead as claimed in claim 1, wherein the passageway plate is formed of a glass substrate.

5. The ink-jet printhead as claimed in claim 1, wherein the condenser lens is integrally formed with the passageway plate.

6. The ink-jet printhead as claimed in claim 1, further comprising:

a lens plate provided on the bottom surface of the passageway plate, the lens plate including the condenser lens.

7. The ink-jet printhead as claimed in claim 1, wherein the laser beam irradiating means is a semiconductor laser.

8. The ink-jet printhead as claimed in claim 1, wherein the condenser lens is convex shaped.

9. The ink-jet printhead as claimed in claim 1, wherein the ink chamber is a plurality of ink chambers positioned at predetermined intervals in the passageway plate, the ink ejection hole is a plurality of ink ejection holes, each formed at a location corresponding to one of the plurality of ink chambers, and the condenser lens is a plurality of condenser lenses, each formed at a location corresponding to one of the plurality of ink chambers.

10. The ink-jet printhead as claimed in claim 9, wherein the laser beam irradiating means comprises:

a semiconductor laser for selectively irradiating the plurality of ink chambers and a light path controller for controlling a path of a laser beam emitted from the semiconductor laser.

11. The ink-jet printhead as claimed in claim 1, wherein the cover plate is a silicon substrate.

12. The ink-jet printhead as claimed in claim 1, wherein the cover plate has a hydrophobic surface.

13. The ink-jet printhead as claimed in claim 1, wherein the ink ejection hole has a shape selected from the group consisting of circular, oval and polygonal.

14. The ink-jet printhead as claimed in claim 1, wherein the ink ejection hole is sufficiently large to prevent contact between the ink droplet being expelled and the cover plate.

15. The ink-jet printhead as claimed in claim 1, wherein the ink droplet expelled through the ejection hole includes ink existing in a liquid state.

16. The ink-jet printhead as claimed in claim 1, wherein:

the laser beam irradiating means includes a laser and a light path controller, and the laser and the light path controller are configured to control an energy of the laser beam to generate a pressurized wave in the ink and to cause a surface of the ink to vibrate such that an amplitude of a wave on the surface of ink increases and to cause a liquid ink droplet to be expelled away from the surface of the ink before the ink reaches a boiling state by limiting an amount of energy being supplied directly to the ink to an amount sufficient to generate a pressurized wave.

17. A method of expelling ink, comprising:

filling an ink chamber with ink;

irradiating a laser beam directly onto the ink contained in the ink chamber to generate a pressurized wave in the ink and vibrating a surface of the ink using the pressurized wave; and expelling an ink droplet from the surface of the ink by the vibration of the surface of the ink, wherein the laser beam has a sufficiently high energy and is irradiated directly onto the ink for a sufficiently short period of time to prevent boiling the ink.

18. The ink expelling method as claimed in claim 17, further comprising:

converging the laser beam using a condenser lens before irradiating the laser beam directly onto the ink.

19. The ink expelling method as claimed in claim 17, wherein the ink chamber is a plurality of ink chambers and irradiating the laser beam directly onto the ink comprises:

selectively irradiating the laser beam directly onto ink contained in one or more of the plurality of ink chambers.

20. The ink expelling method as claimed in claim 17, wherein irradiating the laser beam directly onto the ink includes irradiating the laser beam through a passageway plate that forms a wall of the ink chamber.

21. The ink expelling method as claimed in claim 20, wherein:

the passageway plate is silicon, is in contact with the ink, and is disposed between ink in the ink chamber and the laser beam, irradiating the laser beam directly onto the ink includes irradiating the laser beam through the silicon passageway plate, and the silicon passageway plate is transparent to the laser beam.

22. The ink expelling method as claimed in claim 21, wherein the laser beam has a wavelength in the infrared region.

23. The method as claimed in claim 17, wherein the ink in the ink chamber transforms the laser beam into the pressurized wave.

24. A method of controllably expelling ink onto an recording medium, comprising:

controllably energizing ink in an ink chamber to generate a pressurized wave in the ink and to cause a surface of the ink to vibrate such that an amplitude of a wave on the surface of ink increases and to cause a liquid ink droplet to be expelled away from the surface of the ink before the ink reaches a boiling state by limiting an amount of energy being supplied directly to the ink to an amount sufficient to generate a pressurized wave.

25. The method as claimed in claim 24, wherein:

a passageway plate forms a wall of the ink chamber, the passageway plate being in contact with the ink and disposed between ink in the ink chamber and an energy source that supplies the energy directly to the ink, the passageway plate being transparent to the energy, and supplying the energy directly to the ink includes passing the energy through the passageway plate.

26. The method as claimed in claim 25, wherein:

the passageway plate is silicon, and the energy is infrared light.

* * * * *